US006412668B1

(12) United States Patent
Vlooswijk et al.

(10) Patent No.: US 6,412,668 B1
(45) Date of Patent: Jul. 2, 2002

(54) CONTAINER WITH PRESSURE CONTROL DEVICE FOR DISPENSING FLUID

(75) Inventors: Johannes Jacobus Thomas Vlooswijk, Linschoten; Guido Petrus Johannes van der Klaauw, Zoeterwoude, both of (NL)

(73) Assignee: Heineken Technical Services B.V., Amsterdam (NL)

( * ) Notice: Subject to any disclaimer, the term of this patent is extended or adjusted under 35 U.S.C. 154(b) by 0 days.

(21) Appl. No.: 09/868,282

(22) PCT Filed: Dec. 14, 1999

(86) PCT No.: PCT/NL99/00769

§ 371 (c)(1),
(2), (4) Date: Sep. 6, 2001

(87) PCT Pub. No.: WO00/35773

PCT Pub. Date: Jun. 22, 2000

(30) Foreign Application Priority Data

Dec. 16, 1998 (DE) ..... 298 22 430 U
Aug. 27, 1999 (NL) ..... 1012922

(51) Int. Cl.[7] ..... B65D 83/00
(52) U.S. Cl. ..... 222/396
(58) Field of Search ..... 222/129.1, 135, 222/145.1, 349, 394, 395, 396, 397, 398, 399

(56) References Cited

U.S. PATENT DOCUMENTS 2,794,579 A * 6/1957 McKernan ..... 222/394
5,011,047 A * 4/1991 Cruysberghs ..... 222/396
5,285,931 A * 2/1994 Alfons ..... 222/399
5,439,137 A * 8/1995 Grollier et al. ..... 222/135

FOREIGN PATENT DOCUMENTS

| | | |
|---|---|---|
| EP | 0349053 | 1/1990 |
| FR | 2689866 | 10/1993 |
| FR | 2690142 | 10/1993 |

* cited by examiner

*Primary Examiner*—William C. Doerrler
*Assistant Examiner*—Thach H Bui
(74) *Attorney, Agent, or Firm*—Pearne & Gordon LLP

(57) ABSTRACT

Container with pressure control device for maintaining a substantially constant, preset pressure in the container, said container being arranged for dispensing a fluid, the pressure control device comprising a first chamber for containing a pressure fluid, a second chamber in which a control pressure prevails and a third chamber which is formed by or communicates with, or is at least partially accommodated in an inner space of the container, while between the first chamber and the third chamber there is provided a passage opening accommodating a closing member for closing, during normal use, the passage opening when the pressure in the third chamber is lower than the control pressure, a control means being movable by a displaceable or deformable part of the wall of the second chamber and arranged for displacing the closing member at least partially when the pressure in the third chamber is lower than the control pressure, to enable pressure fluid to flow under pressure from the first chamber to the third chamber, at least the control member and/or the second chamber being at least partially removable from the first chamber and biasing means being provided for keeping the closing member in the closed position when at least the control member and/or the second chamber are at least partially removed.

16 Claims, 4 Drawing Sheets

CONTAINER WITH PRESSURE CONTROL DEVICE FOR DISPENSING FLUID

This application was published in English on Jun. 22, 2000 as International Publication Number WO 00/35773.

The invention relates to a container of the type described in the preamble of the main claim. Such container is known from EP-0 349 053.

This known container comprises a pressure capsule having a first, second and third chamber, the first chamber being filled with a pressurised gas to be discharged into the inner space of said container. On top of said first chamber the second and third chamber are positioned, said third chamber being positioned between the first and second chamber. An outlet opening is provided between said first and third chamber, provided with a closing member biased in a closed position by a spring. The second chamber is separated from the third chamber by a membrane. During operation an operating pressure prevails in the second chamber, moving said membrane depending on the pressure in the third chamber, which during use can freely communicate with the inner space of the container. When the pressure drops in the third chamber, the membrane is moved against the closing member, thereby forcing the closing member to an opening position, such that pressurised gas can be discharged from the first chamber through the third chamber into the inner space. Consequently, the pressure rises in the third chamber, thereby forcing the membrane into the direction of the second chamber, once again closing the closing member.

In this known container, before use, a meltable means is provided for keeping the closing member from being operated by said membrane. In a first embodiment this is achieved by providing said meltable member in the opening between the third chamber and the environment, after pressurising the third chamber to a pressure above the operating pressure prevailing in the second chamber during use. In a second embodiment a ring-shaped meltable element is provided around part of the closing member, thereby preventing movement of said closing member before melting said meltable member.

This known container has the disadvantage that said container has to be heated prior to use, for melting said meltabel member, thereby contaminating the fluid to be dispensed and heating said fluid, which may be undesirable. Furthermore, such container is difficult to assemble and cannot be stored easily over relatively long periods.

A further container having pressurising means is known from FR-A-2 690 142.

This known container comprises an inner space in which a fluid to be dispensed is included, which inner space accommodates a pressure vessel with pressure control means. In the pressure vessel, a first chamber is formed into which a gas is introduced under relatively high pressure, while an outlet opening is provided which is closed by a closing member. This closing member is slightly rod-shaped and is surrounded in the outlet opening by an O-ring which tightly seals thereagainst. Provided in the rod-shaped element is a circumferential groove. In the pressure vessel, a second chamber is formed opposite the first chamber, which second chamber, on she side proximal to the first chamber, is closed by a membrane to which the rod-shaped element is attached by one end thereof. In the second chamber, a control pressure is created by means of a gas. Included between the first and the second chamber is a third chamber through which the rod-shaped element extends and which is provided with an opening forming a fluid connection between the third chamber and the inner space of the container.

When in this known apparatus a desired pressure prevails in the third chamber, for instance a pressure equal to the control pressure, the groove is located in the third chamber and the outlet opening is closed by the rod-shaped element. When fluid is dispensed from the inner space, the pressure therein will fall, resulting in the same pressure fall in the third chamber. Consequently, the membrane-shaped wall part of the second chamber will deform in the direction of the first chamber, while moving the rod-shaped element axially, further into the first chamber. When the groove has been moved to the level of the O-ring, gas under pressure will be able to escape via the groove and along the O-ring from the first chamber to the third chamber, and from there to the inner space of the container. This causes the pressure in the third chamber to rise such that the membrane-shaped wall part is deformed back, against the control pressure, while it moves the rod-shaped element along from the first chamber. When the rod-shaped element is again sealingly clasped by the O-ring, no gas will be able to escape from the first chamber anymore, in which condition the pressure in the third chamber and the inner space is again approximately equal to the desired pressure, in this case the control pressure.

This known container has the drawback that already before the gas is introduced under pressure into the first chamber, the closing member and the control means therefor, in this case the second chamber, the membrane-shaped wall part and the rod-shaped element, must have been fitted. The first chamber is filled by pressing gas under particularly high pressure into the third chamber via the opening, such that the membrane-shaped element is deformed in the direction away from the first chamber. This involves the rod-shaped element being pulled from the first chamber so far that a slightly tapering end thereof is located in the outlet opening. The gas can then pass this end under high pressure and be introduced into the first chamber. Upon removal of the high gas pressure, the rod-shaped element will be moved into the outlet opening again under the influence of the control pressure and close said outlet opening. This has the drawback that the introduction of the gas under pressure is relatively complicated and should be effected through relatively small openings. Moreover, there is the danger that in the case of unduly high filling pressure, the rod-shaped element is pulled from the first chamber entirely and will not return into the outlet opening when the gas pressure is removed, for instance in that the rod-shaped element swivels slightly while the closing O-ring can be pressed from the opening. Moreover, during filling, relatively large deformations of the membrane-shaped wall part will occur. When, after the gas has been introduced into the first chamber, this known apparatus is stored for some time, the control pressure will act on the membrane-shaped element continuously without a desired counterpressure prevailing in the third chamber. After all, the pressure in the third chamber will then be substantially atmospheric. As a consequence, the membrane will be held in a relatively highly deformed state for a relatively long time, which is disadvantageous to the elastic properties thereof. Moreover, this entails the risk of a change of the control pressure caused by gas leaking away from the second chamber along or through the highly deformed membrane.

Moreover, in the case of leakage of the membrane, the control pressure may fall out, so that the closure will be lost and the gas from the first chamber will flow freely to the container, as a result of which the container will be subjected to an unduly high pressure.

A further drawback of this known apparatus is that the rod-shaped body closes the outlet opening of the second chamber by means of an O-ring. This O-ring will continuously be subjected to the high gas pressure in the second chamber. This means that when the O-ring and/or the rod-shaped element are not positioned and/or dimensioned exactly properly, gas can simply flow away between the rod-shaped element and the O-ring. This, too, will eventually cause the gas to flow away from the first chamber to the container and build up an unduly high pressure therein. This is undesirable, both because of the unduly high pressure build-up and because of the poor functioning of the fluid dispensing operation.

The object of the invention is to provide a container of the type described in the preamble, in which the drawbacks of the known container are avoided while the advantages thereof are maintained. In particular, the object of the invention is to provide a container with a pressure control device for maintaining a substantially constant, preset pressure in the container, with the pressure control device enabling simple filling with a pressure fluid and maintaining its pressure-controlling action during relatively long times. To that end, a container according to the present invention is characterized by the features of claim 1.

In a container according to the present invention, pressure fluid can be received and retained in the first chamber without the control means and/or the second chamber having been fitted. Indeed, the closing member is biased in the closed position and will keep the passage opening closed at all times when the control member, at least the second chamber, has been removed, or at least the pressure-controlling action thereof has been put out of operation. The advantage thus achieved is that the control means can be fitted after the first chamber has been filled, while the control means can moreover be stored and transported separately from the first chamber. In addition, there is achieved the advantage that, starting from the same first chamber, different control means can be applied, depending on, for instance, the desired control pressure, a desired travel of the operating member and the like. This also prevents the closing member from being operated prematurely. Indeed, the closing member can be operated by the control means only after assembly. Preferably, the first chamber is filled along the closing member with gas or another pressure fluid under high pressure, but the first chamber can also be filled prior to the positioning of the closing member.

In an advantageous elaboration, an apparatus according to the present invention is characterized by the features of claim 2.

Positioning the closing member at least substantially on the side of the passage opening facing the first chamber offers the advantage that during use, the closing member will be forced in the direction of the passage opening and against the seating under the influence of the pressure prevailing in the first chamber, so as to close the passage opening. Through the provision of limit means which limit the maximum travel of the closing member, the closing member is readily prevented from entering the first chamber loosely. By designing the limit means in a suitable manner, it is provided that pressure gas can be introduced into the first chamber via the passage opening, while passing the closing member in a simple manner. To that end, the limit means may, for instance, be provided with ribs, slots or passage openings, such that the closing member in a position in which it has moved away from the passage opening can abut against at least a part of said ribs or material present between said slots or openings, while releasing fluid connections between the passage opening and the closing member on the one hand and recesses located between said ribs or the slots or passage openings on the other. Also, such ribs, slots or openings may be incorporated into a side, facing away from the seating, of the closing member itself.

It is preferred that as biasing means, spring means be used which bias the closing member in the closed position, also when no excess pressure is present in the first chamber. This readily prevents contamination of the inner space of the first chamber, while, moreover, no gases or solid substances can escape therefrom.

In a further advantageous embodiment, a container according to the present invention is characterized by the features of claim 3.

In such container, the advantage is achieved that the principal direction of movement of the control means will not coincide with the principal direction of movement of the closing member, which creates a greater freedom of design and moreover allows greater tolerances. Indeed, in the case of coinciding principal directions of movement, the position of the second chamber, at least of the control means, will have to be determined particularly accurately with respect to the closing member in at least the closed position. A further advantage of such container may be that an unintentional movement of the control means in the principal direction of movement of the closing member will not, or at least not directly, result in a movement of the closing member. Thus, unintentional release of gas is prevented yet more effectively.

The control means preferably extends at least substantially entirely outside the first chamber, enabling it to be removed in a simple fashion. After all, this does not involve the release of an opening in the first chamber.

In a particularly advantageous embodiment, a container according to the present invention is further characterized by the features of claim 5.

The use of at least a part of a valve as closing member offers the advantage that a closing member biased in the closed position can easily be obtained. The advantage achieved by arranging this in such a manner that it can be opened by at least the control means, is that by means of such valve, a self-regulating pressure control device can be obtained in a container according to the present invention.

In a further advantageous embodiment, a container according to the present invention is characterized by the features of claim 7.

Detachably connecting the control means to the closing member enables positioning the closing member relative to the control means in a relatively simple manner, while movement of the closing member by the control means can readily be effected. A snap connection enables such coupling in a relatively simple manner. Moreover, this may simply prevent detachment of the control means from the closing member, thus preventing malversation.

In a preferred embodiment, a container according to the present invention is characterized by the features of claim 9.

By accommodating the first chamber in a first housing and accommodating the second chamber in a second housing, which housings can be coupled via coupling means, a container according to the present invention can be obtained in a constructionally simple manner. In particular the use of a snap connection enables such coupling in a highly simple manner. Such snap connection is preferably of such design that it cannot be detached again without any problem. As a matter of fact, it will be appreciated that other coupling means can be used as well, for instance bayonet coupling means, screw thread connections or the like.

In an alternative embodiment, there is provided a filling opening for the first chamber, located at a distance from the passage opening. The advantage thus achieved is that the first chamber need not be filled through the passage opening.

In a further alternative embodiment, a container according to the invention is characterized by the features of claim 11.

By collecting gas egressing from the first chamber in a balloon-shaped or otherwise expandable element, the advantage achieved is that contact between and mixing of the fluid to be dispensed and the pressure fluid is prevented. This is in particular advantageous when, for instance for toxic or chemical reasons, the pressure fluid must not be dispensed, or at least not together with the fluid to be dispensed.

The invention further relates to a pressure control device for use in a container according to the invention.

Such pressure control device according to the invention is preferably characterized by the features of claim 13.

By using an intermediate part which can be coupled to the first chamber and which comprises at least the passage opening and the closing member, a relatively simple housing for the first chamber can be obtained with a suitable passage opening. At the desired moment, the second chamber with the control member can then be placed and coupled to the intermediate part, such that the desired pressure control device is obtained, or at least brought into a condition in which it is ready for use. According to the use, a suitable second chamber with suitable control member can in each case be selected.

The invention further relates to a method for preparing a container for dispensing a fluid under substantially constant pressure, characterized by the features of claim 14.

With such method, there is readily obtained a container which, to a user, is directly ready for use. When a part of the fluid contained in the container is removed therefrom, the pressure in the container will in principle decrease. By means of the pressure control device, an amount of pressure fluid, in particular a gas, will thereupon be released from the first chamber to compensate for said pressure decrease. Preferably, the pressure in the inner space of the container is controlled such that it is sufficient for pressing the fluid from the container at a desired pressure. However, it will be understood that it is also possible to control the pressure in the inner space at a relatively low level, for instance atmospheric or subatmospheric, while the fluid introduced into the inner space can, for instance, serve as shielding gas or be used to prevent the occurrence of a reduced pressure in the inner space, which, after all, will prevent the fluid from being dispensed or will at least render it more difficult.

The invention moreover relates to the use of a container or a pressure control device according to the invention for dispensing carbonated beverage, in particular beer, under substantially constant pressure, and to the use of a method according to the present invention therefor.

As pressure fluid, preferably a gas, in particular $CO_2$ or $CO_2$-containing gas, is used in an apparatus or method according to the invention. However, another pressure medium may be used as well, for instance a liquid. Also, a pressure fluid may be obtained in a chemical manner, for instance by combining calcium, (bi) carbonate and an acid such as citric acid. Thus, a pressure gas, in particular $CO_2$, is created. Many variations thereof are possible. The (bi) carbonate or another, calcareous product may be included in the third chamber, at least on the opposite side of the closing member.

Further advantageous embodiments of a container, pressure control device and method according to the invention are given in the subclaims.

To clarify the invention, a number of exemplary embodiments of a container, pressure control device, method and use according to the invention will hereinafter be further explained with reference to the accompanying drawings. In these drawings.

Figure 2:
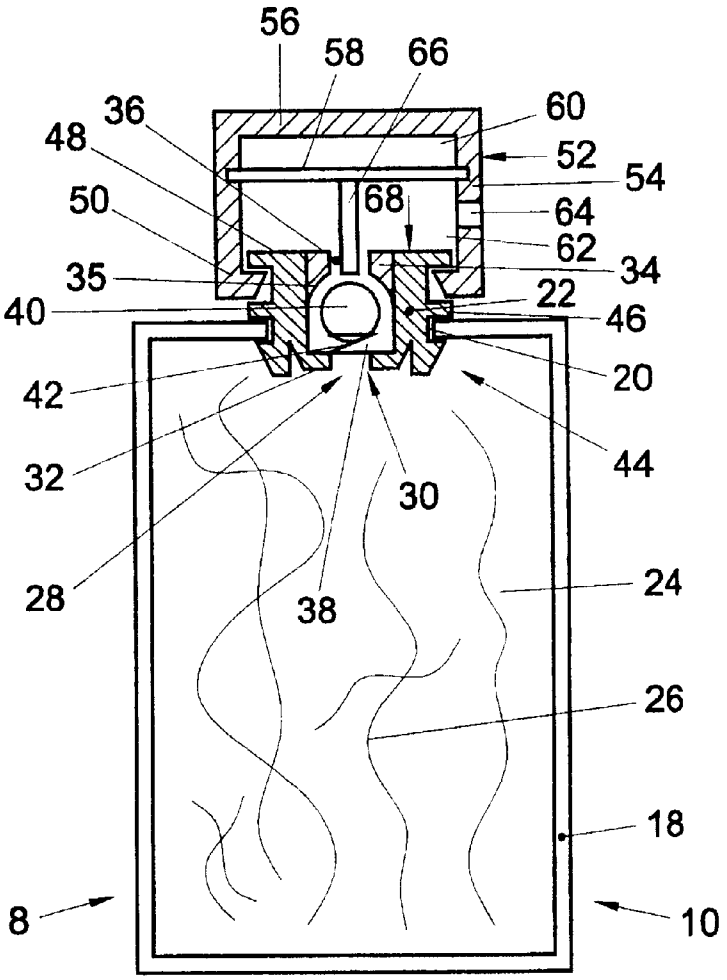
FIG. 2 is a schematic sectional side elevation of a pressure control device in a first embodiment.

In this specification, the invention will mainly be described with reference to a container having a pressure control device for dispensing beverage, in particular soft drink, more in particular carbonated beverage such as beer, yet it will be understood that with such apparatus, other fluids can be dispensed as well, for instance cosmetic products, foam-forming products, gases and the like. In this specification, reference will mainly be made to the dispensing, under pressure, of a fluid. However, by means of the pressure control device, it is also possible to maintain a constant pressure in the container, for instance at the level of the environment of container, for instance to prevent deformation of the container or blocking of the dispensing operation or to protect the contents of the container against contamination from outside. In this specification, identical or corresponding parts have identical or corresponding reference numerals.

Figure 1:
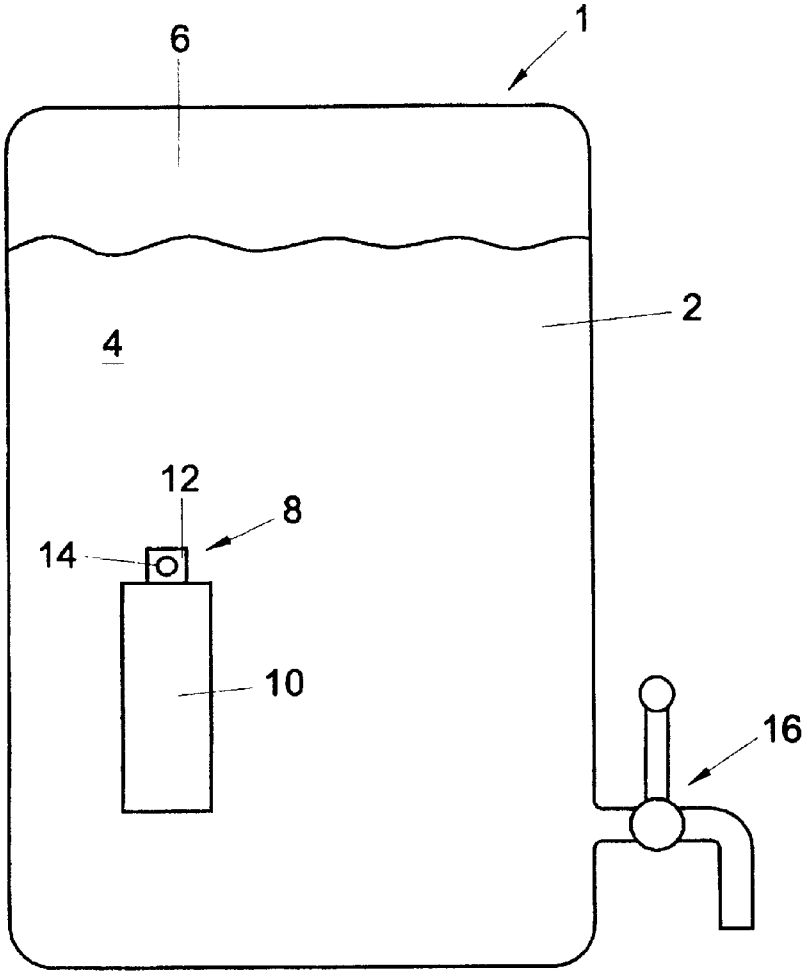
FIG. 1 is a schematic sectional side elevation of a container having a pressure control device according to the present invention.

FIG. 1 shows, in highly schematic form, a sectional side elevation of a container 1, in the form of a substantially cylindrical can in which, in the inner space 4 thereof, beverage 2 is included. In the container 1, a head space 6 may be present, for instance filled with carbon dioxide. There is further included in the container 1 a pressure control device 8, comprising a pressure vessel 10, a valve assembly 12 and an outlet opening 14. In the pressure vessel 10, a gas is stored under relatively high pressure in a manner to be described in more detail hereinbelow. By means of the valve assembly 12, gas can be introduced, in a manner to be described in more detail hereinbelow, from the pressure vessel 10 into the inner space 4 of the container 1 via the pressure control device 8, for controlling the pressure therein. In the embodiment shown in FIG. 1, a tap 16 is provided in the sidewall of the container 1, whereby beverage 2 can be discharged from the inner space 4.

FIG. 2 shows a pressure control device 8 in a first embodiment, comprising a cylindrical first housing 18 forming the pressure vessel 10 and having, adjacent the top end thereof, a filling opening 20 in which an intermediate part 22 is secured in a manner to be described in more detail hereinbelow. Formed within the first housing 18 is a first chamber 24, largely filled with activated carbon, for instance activated carbon fiber 26 having a high adsorption and absorption power for the pressure gas, such as $CO_2$. This enables the introduction of a particularly large amount of pressure gas into the first chamber 24 in relation to the pressure thereby obtained. This offers the advantage that the first chamber 24 can be relatively small and yet contain sufficient gas. Such use of activated carbon is described in applicant's earlier filed Dutch patent application 1009654, which application is understood to be incorporated herein by reference.

Instead of or in addition to the $CO_2$, another pressure fluid may also be included in the first chamber, for instance a liquid under pressure. If necessary, a reactive substance may also be included in the first chamber, which substance can react with a second reactive substance to form a pressure medium such as $CO_2$. These may be, for instance, an acid and a calcium product, such as citric acid and (bi) carbonate, while the second reactive component may be stored in the first chamber and reacts only in the case of pressure reduction, or in the third chamber, at least on the side of the closing member remote from the first chamber. In that case, the reaction between the components does not take place until the closing member is temporarily controlled into the open position when the pressure in the inner space of the container is reduced and the components are brought together or undergo sufficient pressure change to form the desired gas. Other reactions, too, may be applied in a suitable manner, to be selected depending on, inter alia, the medium to be dispensed.

The intermediate part 22 comprises a passage opening 28, which is partially closed adjacent its bottom end by an inwardly extending flange 30 provided with a number of bypass openings 32. From the top end, a seating 34 is inserted into the passage opening 28, of which seating 34 the side facing the flange 30 has a convex surface to which an axial bore 36 connects. Between the convex surface 35 and the flange 30, a cavity 38 is formed in which a ball-shaped closing member 40 is movably included, which closing member 40 is biased against the convex surface 35 and the axial bore 36 by biasing means 42 and in said biased position closes the axial bore so as to be gastight and liquidtight. In the embodiment shown, the biasing means 42 are designed as a pressure spring supported on the flange 30.

As FIG. 2 shows, the intermediate part 22 comprises first coupling means 44 in the form of snap fingers or a snap ring which can be pressed, with deformation, through the filling opening 20 and secured under the longitudinal edge thereof. A supporting edge 46 is provided, abutting against the top side of the longitudinal edge of the filling opening 20. In this manner, the intermediate part 20 is coupled in a positionally fixed manner to the first housing 18, with the first coupling means 44 and the supporting edge 46 providing a gastight and liquidtight seal. For that purpose, packing means such as a rubber ring, liquid packing, deforming means or the like, not shown, may be suitably provided, if necessary. Provided at some distance above the supporting edge 46 is a second, further coupling means 48, in the form of a longitudinally extending longitudinal edge, parallel to the supporting edge 46. Under these second coupling means 48, countercoupling means 50 of a second housing 52 can be secured. This second housing 52 comprises a cylindrical longitudinal wall 54, closed on one side by an end wall 56, while on the opposite side, the countercoupling means 50 are provided in the form of snap fingers or a snap edge or the like. Provided within the second housing 52 is a circular membrane 58 whose longitudinal edge is gastightly and liquidtightly secured in the longitudinal wall 54. Between the end wall 56, the longitudinal wall 54 and the membrane 58, a second chamber 60 is confined, of which the membrane 58 constitutes a deformable wall part. Included between the membrane 58, the longitudinal wall 54 and the first chamber 24 is a third chamber 62 which, via at least one outlet opening 64, is in fluid connection with the inner space 4 of the container 1. From the membrane 58, a rod-shaped control means 66 extends through the axial bore 36 to a position adjacent the closing member 40. The control means 66 has its first end secured to the center of the membrane 58, such that upon deformation of the membrane 58, the control means 66 is moved in axial direction. The length of the control means 66 is chosen such that at an preselected increase of the volume of the second chamber 60, through deformation of the membrane 58, the free end, distal from the membrane 58, of the control means 66 presses the closing member 40 from the seating 34, allowing gas to flow under pressure via the passage openings 28 and the bypass openings 32, the cavity 38 and the axial bore 36 into the third chamber 62, and from there into the inner space 4 of the container 1 via the outlet opening 64. In this manner, the pressure in the inner space 4 of the container can be increased, for instance in order to bring this pressure to a desired level when beverage has been discharged from the container 1.

Prior to use, a pressure medium, for instance a gas, is provided in the second chamber 60, under a primary pressure to be referred to as control pressure, for instance slightly higher than the pressure which is desired in the inner space 4 of the container 1. The extent to which this control pressure is higher than the desired pressure for the inner space 4 is substantially determined by the bias produced by the biasing means 42. When the control pressure prevails in the second chamber 60, the membrane 58 extends flat and parallel to the end wall 56, the free end of the control means 66 being located adjacent the closing member 40. When via the tap 16, beverage 2 is discharged from the inner space 4, the pressure in the container will decrease. This means that the pressure in the third chamber 62 will likewise decrease, as a result of which, due to the difference in pressure between the second chamber 60 and the third chamber 62, the membrane 58 will be deformed, while the volume of the second chamber 60 increases. This involves the control means 66 being moved against the closing member 40, pushing said closing member from the seating 34, against the biasing means 42. Accordingly, gas under pressure flows from the first chamber 24 along the closing member 40 into the third chamber 62 and towards the inner space 4. When the pressure in the third chamber 62 and hence in the inner space 4 has been brought back to the desired level, the membrane 58 is forced back into its flat position, as shown in FIG. 2, while moving along the control means 66. Accordingly, by the biasing means 42, the closing member 40 is pressed back into the closing position against the seating 34. In this manner, each time when the pressure in the inner space 4 drops below a desired level, gas will be supplied from the first chamber 4 to the inner space, so that pressure control is automatically obtained. If necessary, the membrane may be of a slightly dish-shaped design, with the control pressure in the second chamber 60 corresponding to the primary, desired pressure when the convex side of such membrane 58 faces the second chamber. In such embodiment, an additional pressure difference is required between the second and third chambers to obtain a sufficient displacement of the control means 66 for pushing the closing member 40 from the seating 34. Moreover, upon opposite movement of the membrane 58, the pressure in the third chamber 62 will have to be increased slightly further than in the case where a flat membrane 58 is used, to deform the membrane from its concave shape, viewed from the second chamber 60, back into its convex shape. This means that when the closing member 40 is open, the pressure in the inner space 4 will be raised to slightly above the desired pressure, while gas will not be fed from the first chamber 24 into the inner space 4 until the pressure in the inner space 4 has dropped below the desired level.

In the second chamber 60, a combination of, for instance, a gas and another fluid or a gas and a solid can be included as pressure medium, such that the control pressure is related to, for instance, the temperature of the beverage 2 in the container 1. Thus, for instance in the second chamber 60, an amount of the beverage 2 or a fluid corresponding therewith can be included, while depending on the temperature in the second chamber, gas from the beverage included therein will provide an increase or decrease of pressure in the second chamber. The same effect can be achieved by including gas adsorbing or absorbing means in the second chamber 60, whose adsorption or absorption power depends on, inter alia, the temperature. In this manner, an even better control of the pressure in the inner space 4 can be realized.

A pressure control device 8 according to the invention can be used as follows. Via the filling opening 20, an appropriate amount of filling material 26 is introduced into the first chamber 24, for instance activated carbon fibers, activated carbon powder or like gas adsorbing and/or absorbing agents, known from, for instance, EP 5 692 381, which is understood to be incorporated herein by reference. Next, the intermediate part 22 is sealingly secured in the filling opening by the first coupling means 44, after which a filling head (not shown) can be connected to the intermediate part 22, such that gas under pressure can be introduced into the first chamber 24 via the axial bore 36 and along the closing member 40. The gas pressure is so high that the closing member 40 is moved from the seating 34, against the biasing means 42. Said filling head may be provided with coupling means comparable with the countercoupling means 50, enabling the filling head to be connected to the second coupling means 48 of the intermediate part. If the gas pressure in the filling head is removed, the closing member 40 will be pressed back against the seating 34 by the biasing means 42 and close the axial bore 36, such that the gas under pressure is trapped in the first chamber 24. Next, preferably directly prior to use, the second chamber 52 can be connected to the intermediate part 22 by the second coupling means 48, in the manner described hereinabove, whereupon the pressure control device is ready for use.

In the embodiment shown in FIG. 2, the closing member 40 is located at a distance below the top surface 68 of the intermediate part 22, preventing the closing member 40 from being pressed from the seating 34 unintentionally. The first housing 18 with the intermediate part 22 can, with filled first chamber 24, be stored and transported separately from the second housing 52. This offers logistic advantages, while, moreover, gas is readily prevented from escaping from the first chamber 24 unintentionally. Indeed, the pressure control will be initiated only after coupling of the first housing 18 and the second housing 52. A further advantage is that in each case, depending on the desired application, in particular the pressure to be controlled, a suitable second housing 52 can be coupled to the first housing 18, at least the intermediate part 22, depending on, for instance, the desired control pressure. Moreover, undesired loading of the membrane 58 can readily be prevented, for instance by closing the bottom side of the third chamber by a suitable cap when the second housing 52 has been uncoupled from the intermediate part 22. The control means 66 can then receive support from the inner side of said cap. A further particular advantage of a pressure control device according to the present invention is that the filling means for introducing the gas into the first chamber 24 can be of relatively simple design, comparable with filling devices for existing aerosol containers and the like. As the gas need not be introduced under pressure via the relatively small outlet opening 64 and the third chamber 62, filling can be performed relatively fast, in particular also because during filling, the control means 66 does not extend into the axial bore.

Figure 3:
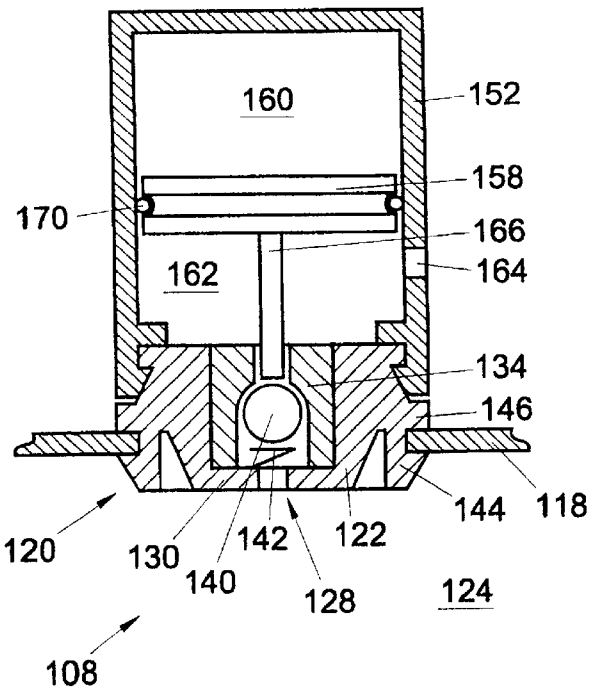
FIG. 3 is a sectional side elevation of a detail of a pressure control device according to the invention in a first alternative embodiment.

FIG. 3 shows a portion of an alternative embodiment of a pressure control device according to the present invention, in which, again, an intermediate part 122 is secured in the filling opening 120 of the first housing 118 by first coupling means 144 and an associated supporting edge 146. In the above-described manner, the second housing 152 is secured on the intermediate part 122. In this embodiment, a piston 158 is arranged in the second housing 152, which piston is connected to the control means 166. The piston comprises an O-ring 170 or a like piston spring, to create a gastightly and liquidtightly closed second chamber 160 on the side of the piston 158 distal from the first chamber 124, with intermediate third chamber 162.

Figure 4:
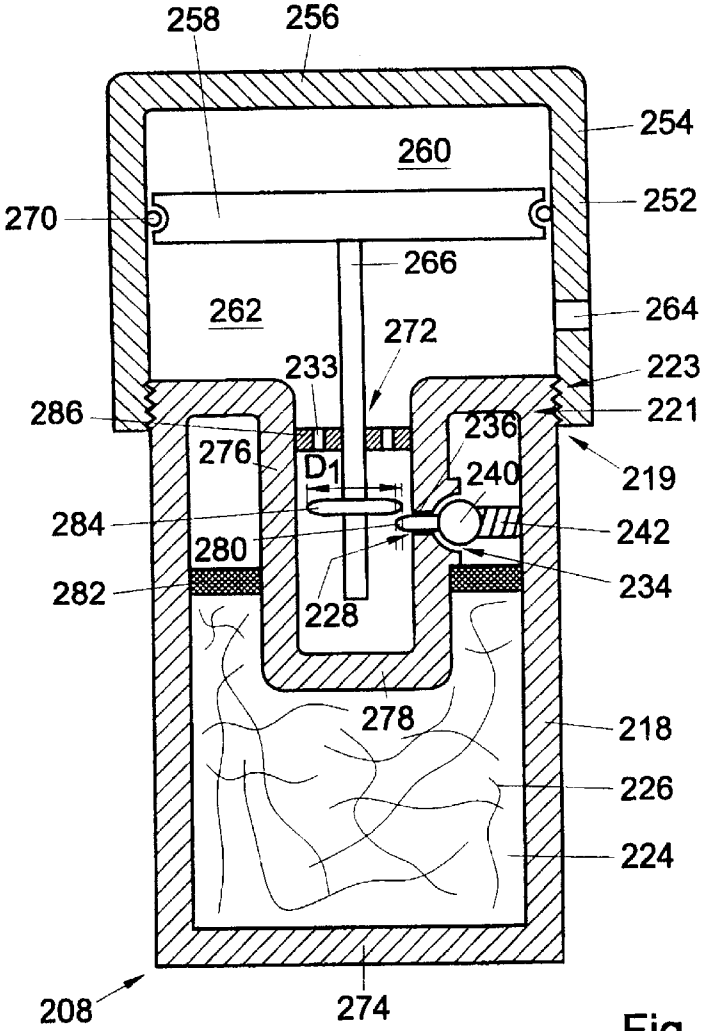
FIG. 4 is a sectional side elevation of a detail of a pressure control device in a second alternative embodiment.

FIG. 4 shows a second alternative embodiment of a pressure control device according to the invention, in which the first housing 218 is provided, adjacent its top side 219, with external screw thread 221, capable of cooperating with internal screw thread 223, adjacent the bottom end of the second housing 252. The second housing 252 is cap-shaped, provided with a cylindrical longitudinal wall 254 and a closed end wall 256. Accommodated within the second housing 252 is again a piston 258 with piston spring 270, thus dividing the second housing 252 into a second chamber 260 and a third chamber 262. Within the first chamber 224, adsorbing and/or absorbing material 226 is again included.

In this second alternative embodiment, a substantially cylindrical recess 272 extends from the top end 219 of the first housing 218 in the direction of the bottom 274 of the first housing 218, coaxially with the first housing 218. The recess 272 is open at the top side, comprises a longitudinal wall 276 and a bottom 278. Provided in the longitudinal wall 276 is a passage opening 228, comprising an axial bore 236, which bore, on the side remote from the recess, connects to a seating 234. By means of spring-shaped biasing means 242 receiving support from, for instance, the inner side of the longitudinal wall of the first housing 218, a substantially ball-shaped closing member 240 is pressed against the seating 234. A pin 280 is fixedly connected to the closing member 240 and extends through the axial bore 236 into the recess 272. In the biased position, the closing member 240 is sealingly pressed against the seating 234. In the first chamber 224, a filter 282 is provided between the longitudinal wall 276 of the recess 272 and the outer wall of the first housing 218, which filter is permeable to gas, but which prevents the material 226 from reaching the closing member 240 and the passage opening 228.

From the bottom side of the piston 258, a rod-shaped control member 266 extends into the recess 272. Within the recess, a disk-shaped pressure element 284 is provided around the control member 266, which pressure element extends parallel to the piston 258 and has a diameter D such that upon axial movement of the control member 266, the pressure element 284 is contacted with the free end of the pin 280. Hence, further movement of the pressure element 284 from the position shown in FIG. 4 in the direction of the bottom 278 will cause the pin 236 to be moved in axial direction, further into the axial bore, while the closing member 240 will be moved from the seating 234 against the biasing means 242. The advantage thus achieved is that gas can flow from the first chamber 224 along the seating 234 and the closing member 240 via the passage opening 280 into the recess 272, which recess connects to or forms part of the third chamber 262. From the third chamber, the gas can flow away via the outlet opening 264. Axial movement of the control member 266 is again effected by pressure difference between a control pressure in the second chamber 260 and the pressure in the third chamber 262. Preferably, a spacer ring 286 is included in the recess 272, which spacer ring can guide the control member 266. In the spacer ring, bypass openings 233 may be included for passing the gas. The spacer ring 286 preferably has a diameter which approximately corresponds to the inside diameter of the recess 272. The spacer ring can move along with the control member 266 or guide it. Of course, it is also possible to design the pressure element with a diameter which is approximately equal to the inside diameter of the recess 272, such that the pressure element simultaneously performs the function of the spacer ring, as a result of which the spacer ring can be left out.

In a pressure control device according to FIG. 4, the first housing 218 is, for instance, screwed with the external screw thread 221 into the filling head of a filling device, whereupon gas is introduced under pressure into the first chamber 224 in the manner described hereinabove. After detachment of the first housing 218 from the filling head, the second housing 252 with piston 258 and control member 266 can be screwed onto the first housing 218, after which the pressure control device 208 is ready for use. As a matter of fact, it will be understood that instead of a compression spring, other types of biasing means 242 may also be applied to pressure control devices according to the present invention, for instance resilient fingers, flexible elements or the like. Also, the closing member may be partially designed as piston and included in an appropriate cylinder, so that compression of a suitable fluid within the cylinder may provide the desired bias.

Figure 5:
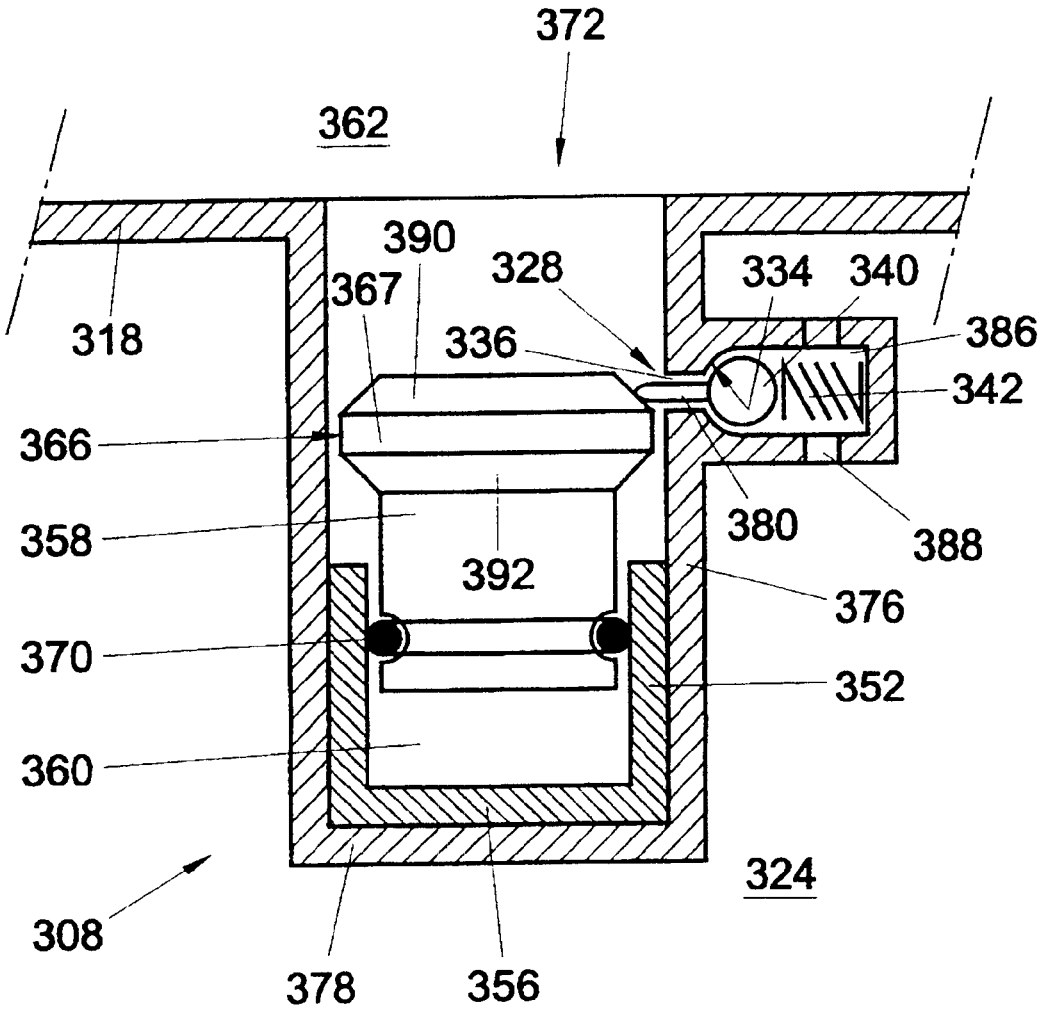
FIG. 5 is a sectional side elevation of a detail of a pressure control device in a third alternative embodiment.

FIG. 5 shows a portion of a third alternative embodiment of a pressure control device 308 according to the invention, slightly comparable with an embodiment according to FIG. 4. In this embodiment, a passage opening 328 is again provided, with axial bore 334, in the recess 372 in the first housing 318. By biasing means 342, a closing member 340 is forced against the seating 334, with the pin 380 extending through the axial bore 336 into the recess 372. In this embodiment, the biasing means 342 and the closing member 340 are accommodated in a fourth chamber 386 with inflow openings 388. This allows the recess 372 to be located at a relatively large distance from the wall of the first housing 218.

In this third alternative embodiment, the second housing 352 is accommodated in the recess 372, such that it has its end wall 356 abutting against the bottom 378 of the recess. In this embodiment, the piston 358 is designed as a cylinder whose outer circumference approximately corresponds to the inner circumference of the second housing 252, with the interposition of an appropriate piston spring 370 or like gastight and liquidtight sealing means. Between the piston 358 and the end wall 356, the second chamber 360 is formed again. At the end of the piston 358 distal from the second chamber 360, there is provided a control member 366, designed as a disk 367 having frusto-conical longitudinal edges 390, 392. The disk 367 has an outside diameter which, for instance, approximately corresponds to the inside diameter of the recess 372, while the smallest section of the frusto-conical longitudinal edges 390, 392 are approximately equal to the section of the piston 358. When the piston 358 is in a neutral position, i.e. in a condition in which the pressure in the second chamber 360 is equal to the desired control pressure, the pin 380 has its free end abutting against the outer frusto-conical longitudinal edge 390, preferably adjacent the free end thereof. When the pressure in the third chamber 362, which in the embodiment shown is formed by the inner space 4, decreases, the piston 358 will be moved upwards by the pressure in the second chamber 360, i.e. in the direction away from the end wall 356. This involves the first frusto-conical longitudinal edge 390 pushing away the pin 380 and, accordingly, the closing member 340 outwards, to release a gas flow path from the first chamber 324 via the inflow openings 388, the fourth chamber 386 and the passage opening 328 towards the third chamber 362.

The end wall 356 of the second housing 352 has its outer side beveled, such that when the second housing 352 is pressed into the recess 372, it can easily pass the pin 380. For the same reason, the second frusto-conical longitudinal edge 392 of the disk 367 has been provided. As a matter of fact, in the longitudinal wall 354 of the second housing 352 there may be provided a groove for allowing the free end of the pin to pass without it being pressed away.

In this embodiment, gas can be introduced into the first chamber 324 via the passage opening 328, after which the second housing 352 can be pressed into the recess 372 so as to render the device suitable for use. In fact, it will be understood that in this embodiment, the second housing 252 can be fitted prior to the introduction of the gas into the first chamber 224. However, this means that the piston 358 will have to be secured in a position at which the control pressure prevails in the second chamber 360, also when in the third chamber, at least in the environment of the pressure control device, there prevails a pressure lower than the pressure that is desired in the inner space 4 of the container 1.

Figure 6:
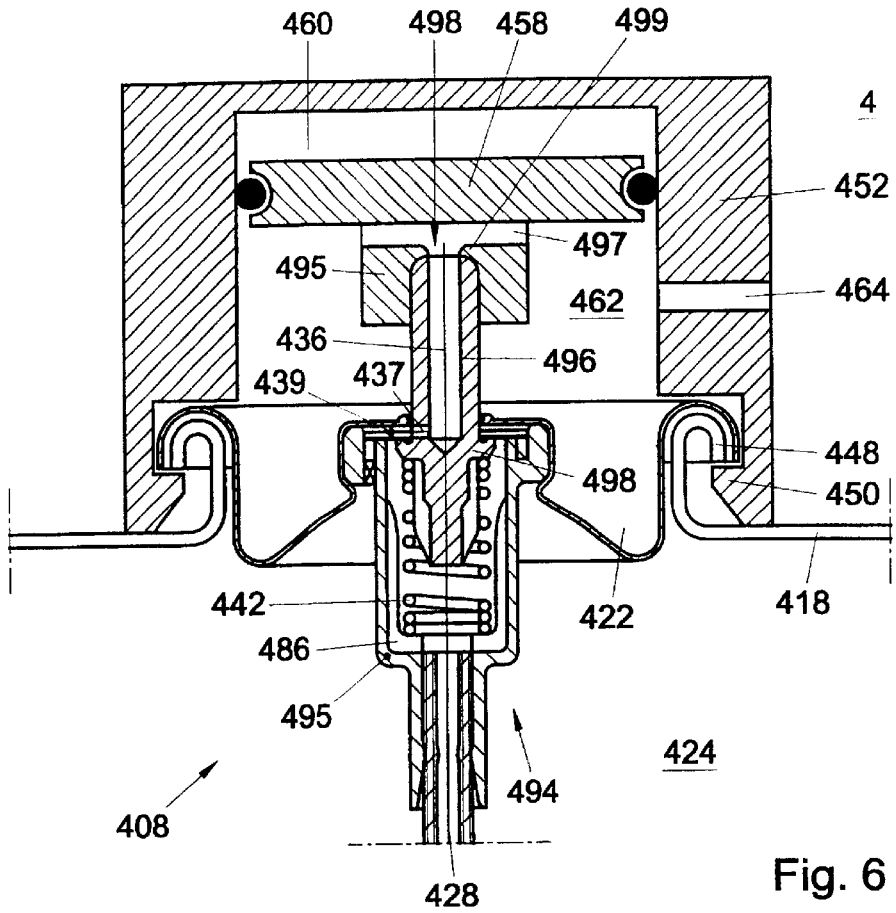
FIG. 6 shows a detail of a pressure control device in a fourth alternative embodiment.

FIG. 6 shows a portion of a fourth alternative embodiment of a pressure control device 408 according to the invention, comprising a first housing 418, an intermediate part 422 and a second housing 452. Accommodated in the intermediate part 422 is a valve 494 of a type which is usually employed in spray cans, such as aerosol containers and the like. Such valve is known from practice. FIG. 6 shows a suitable embodiment of a valve 494, yet it will be appreciated that differently designed valves may also be used in a pressure control device according to the present invention. In the embodiment shown, the valve comprises a third housing 495 which is fixedly connected to the intermediate part 422 and which contains a fourth chamber 486 including a pressure spring 442 as biasing means. A rod-shaped element 496 lies with a collar 498 confined between the coupling part 422 and the top end of the spring 442, and extends beyond the coupling part 422. Provided in the part lying outside the coupling part 422 is an axial bore 436 in the form of a blind hole. Provided above the collar 498 is a radial bore 437, terminating in the axial bore 436. In the position shown in FIG. 6, the radial bore 437 is closed by a sealing ring 439 in the intermediate part 422. On the intermediate part 422, the second housing 452 is mounted with appropriate coupling means 448, 450 in the above-described manner, which second housing 452 accommodates a piston 458 for axial displacement. Within the second housing 452, the second chamber 460 is separated from the third chamber 462 by the piston 458. Via the outlet opening 464, the third chamber 462 communicates with inner space 4 of the container. On the bottom side of the piston 458, a cylindrical part 495 is formed having an axial bore 498 which can be fittingly secured over the top end of the rod-shaped element 496. On the side proximal to the piston 458, a collar 499 is provided in the axial bore 498, which collar receives support from the top end of the rod-shaped element. From the axial bore 498, radial bores 497 extend, which bring the axial bore 498 into fluid connection with the third chamber 462.

In this embodiment, an increase of the volume of the second chamber 460, which will be effected in the above-described manner, results in a displacement of the piston 458 in the direction of the first chamber 424, whereby the rod-shaped element. 496 is axially displaced in the direction of said first chamber 424, against the bias of the spring 442. Thus, the fluid connection is obtained between the first chamber 424 and the third chamber 462 via the passage opening 428, the fourth chamber 486, the radial bore 437, the axial bores 436, 498 and the radial bores 497. Such embodiment offers the advantage that in a suitable manner, use can be made of valves 494 known per se or the like, while, moreover, use can be made of spray cans, aerosol containers and the like, known per se, as part for a pressure control device according to the present invention. It will be understood that the first chamber 424 can be filled with gas when the second housing 452 with the piston 458 is removed, while the second housing 452 can be fitted in a simple manner.

Figure 7:
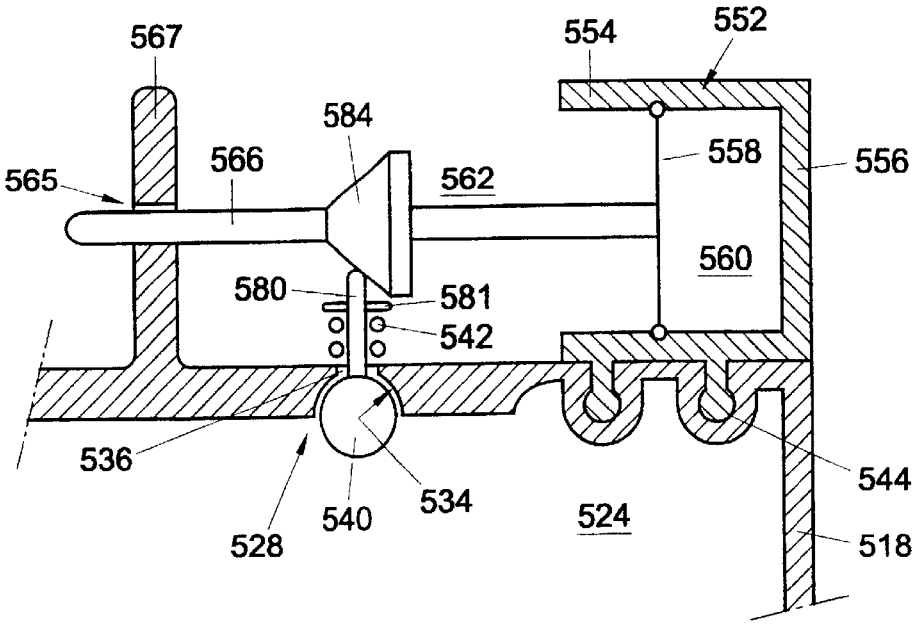
FIG. 7 is a sectional side elevation of a portion of a pressure control device according to invention in a fifth alternative embodiment.

FIG. 7 shows a fifth alternative embodiment for a pressure control device according to the present invention, in which the passage opening 528 with the axial bore 536 and the seating 534 are provided in the outer wall of the first housing 518, for instance in the top wall thereof. On the pin 580, which extends from the closing member 540 and through the axial bore 536, a clamping ring 581 is provided. Between the clamping ring 581 and the longitudinal edge of the axial bore 536, a spring 542 is included as biasing means. At some distance from the passage opening 528, the second housing 552 is secured on the relevant wall part of the first housing 518, for instance by means of snap fingers 544 suitable therefor or comparable suitable coupling means. The first housing 518 comprises a longitudinal wall 554 and an end wall 556, which extends approximately at right angles to the relevant wall parts of the first housing 518. The longitudinal wall 554 may, for instance, define a substantially rectangular section of the inner space of the second housing. In the second housing 552, a membrane 558 has its longitudinal edge secured in a manner as described in relation to FIG. 2. From the center of the membrane 558, a control member 556 extends approximately parallel to said wall part of the first housing, through a guide opening 565 in a vertical edge 567 extending from said wall part of the first housing 518. It is thus guaranteed that the control member 566 can move only axially, under the influence of changes of volume of the second chamber 560. On the control member 566, a frusto-conical pressure element 584 is coaxially secured, having its frusto-conical surface abutting against the free end of the pin 580. The frusto-conical pressure element 584 tapers in the direction of the vertical edge 567. Hence, when the volume of the second chamber 560 increases, the pin 580 and, accordingly, the closing member 540 in FIG. 7 will be forced downwards, i.e. in the direction of the first chamber 524, against the biasing means 542, thereby releasing the passage opening 528 at least partially. The directions of movement of the pressure element and the control member enclose an angle of about 90°.

An apparatus according to FIG. 7 will enable gas to be introduced into the first chamber 524 via the passage opening 528 when second chamber and control member have been removed. Prior to use, the control member 566 is subsequently passed with its first end through the guide opening 565, after which the second housing 552 is coupled to the first housing 518 by means of the snap fingers 544.

In principle, control devices according to the present invention have as an important additional advantage that in the event of a fall-out of the control pressure in the second chamber, for instance due to leakage, the control member is forced into a closed position. This readily and effectively prevents gas from flowing away in an uncontrolled manner from the first chamber to the third chamber to cause an unduly great pressure in the container, at least in the third chamber. Thus, the safety of the container according to the present invention, at least of a pressure control device to be used therewith, is enhanced even further.

The invention is in no way limited to the exemplary embodiments shown in the specification and drawings: many variations thereof are possible within the framework of the invention, as outlined in the appended claims.

For instance, at a distance from the outlet opening, a secondary filling opening may be provided through which gas can be introduced into the first chamber. Such secondary filling opening may, for instance, have the advantage that it can be of a relatively large design, so that filling of the first chamber can be realized even more rapidly, while an outlet opening of a suitable, relatively small dimension can be maintained. Further, a pressure control device can be secured and positioned in a container in different manners, depending on the use. Also, parts of the pressure control device, in particular the first housing, may form part of the container, for instance as a fixed compartment thereof. Of course, different embodiments as shown may also be combined. Biasing means for a device according to the present invention may be arranged separately from the closing member, but may also form an integral part thereof, so that the number of parts required is further reduced. It will be understood that when the pressure in the container is set relatively high, the beverage or any other medium or even, for instance, powder or granular product can be forced from the container via an opening which may be provided in the container in any desired position, for instance in a side or top face. Also, discharge means other than a tap 16 may be used. It will further be understood that the pistons and membranes used in devices according to the present invention may have any desired, suitable shape, for instance round, rectangular or polygonal in section, and may be made from any suitable material, for instance plastic or metal. The same holds for the different housings, intermediate part, control member and closing member. In the exemplary embodiments shown, a substantially ball-shaped element is in each case used as closing member. However, it will be understood that differently shaped closing members may be used as well, for instance frusto-conical, disk-shaped and the like. In the case of non-ball-shaped closing members, the closing member can in each case be positioned in such a manner that the gas pressure in the first chamber will exert an additional pressure on the closing member in the direction of the seating cooperating therewith for increasing the bias. The coupling means for a pressure control device according to the present invention may be of reversible design, yet it is preferred that these means cannot be detached without damage, so that they cannot be manipulated in an undesirable manner.

These and many comparable variations are understood to fall within the framework of the invention as described in the claims.

What is claimed is:

1. A container (1) with pressure control device (8, 108, 208, 308, 408, 508) for maintaining a substantially constant, preset pressure in the container, said container (1) being arranged for dispensing a fluid, the pressure control device comprising a first chamber (24, 124, 224, 324, 424, 524) for containing a pressure fluid, a second chamber (60, 160, 260, 360, 460, 560) in which a control pressure prevails and a third chamber (62, 162, 262, 362, 462, 562) which is formed by or communicates with, or is at least partially accommodated in an inner space of the container (1), while between the first chamber (24, 124, 224, 324, 424, 524) and the third chamber (62, 162, 262, 362, 462, 562) there is provided a passage opening (28. 128, 228, 328, 428, 528) accommodating a closing member (40, 140, 240, 340, 440, 540) for closing, during normal use, the passage opening (28. 128, 228, 328, 428, 528) when the pressure in the third chamber (62, 162, 262, 362, 462, 562) is lower than the control pressure, a control means (66, 166, 266, 366, 466, 566) being movable by a displaceable or deformable part (58, 158, 258, 358, 458, 558) of the wall of the second chamber (60, 160, 260, 360, 460, 560) and arranged for displacing the closing member (40, 140, 240, 340, 440, 540) at least partially when the pressure in the third chamber (62, 162, 262, 362, 462, 562) is lower than the control pressure, to enable pressure fluid to flow under pressure from the first chamber (24, 124, 224, 324, 424, 524) to the third chamber (62, 162, 262, 362, 462, 562), biasing means being provided for biasing said closing member to a closed position, characterized in that at least the control member (66) and/or the second chamber (60, 160, 260, 360, 460, 560) are at least partially removable from the first chamber (24, 124, 224, 324, 424, 524) and said biasing means (42, 142, 242, 342, 442, 542) being provided for keeping the closing member (40, 140, 240, 340, 440, 540) in the closed position when at least the control member (66, 166, 266, 366, 466, 566) and/or the second chamber (60, 160, 260, 360, 460, 560) are at least partially removed, such that the first chamber (24, 124, 224, 324, 424, 524) can be filled while the second chamber (60, 160, 260, 360, 460, 560) and/or the control means can be stored and transported separately from the first chamber (24, 124, 224, 324, 424, 524).

2. A container according to claim 1, wherein the closing member (40, 140, 240, 340, 440, 540) is positioned at least substantially on the side of the passage opening (28, 128, 228, 328, 428, 528) facing the first chamber (24, 124, 224, 324, 424, 524) and can close the passage opening (28, 128, 228, 328, 428, 528) by abutting against a seating around the passage opening (28, 128, 228, 328, 428, 528), limit means (32, 132, 232, 332, 432, 532) being provided for limiting the possible travel of the closing member (40, 140, 240, 340, 440, 540), such that when the closing member (40, 140, 240, 340, 440, 540) is moved away maximally from the passage opening, a fluid can be introduced into the first chamber along the closing member (40, 140, 240, 340, 440, 540).

3. A container according to claim 1, wherein the control means (366, 466, 566) has a principal direction of movement enclosing an angle with the principal direction of movement of the closing member (340, 440, 540), said angle preferably ranging between 90 and 175 degrees, more in particular between 90 and 135 degrees and preferably being about 90 degrees.

4. A container according to claim 1, wherein the second chamber (60, 160, 260, 360, 460, 560) and the control means (66, 166, 266, 366, 466, 566) are at least largely removable, the closing member in its closed position being located below an outer surface of the pressure control device of the first chamber (24, 124, 224, 324, 424, 524) in which the passage opening (28, 128, 228, 328, 428, 528) is located.

5. A container according to claim 1, wherein the closing member (440) is designed as part of a valve (494), arranged for being moved from a closed position into an open position by at least the control means.

6. A container according to claim 1, wherein the control means (266, 366, 566) comprises a rod-shaped element having at least a part which in a direction approximately at right angles to the longitudinal axis of the relevant element projects outside an adjoining part, while during axial movement of the relevant rod-shaped element, the projecting part can be brought into and out of contact with the closing member, the closing member (240, 340, 540) being pressed into the open position when the projecting part is in contact therewith and being forced into the closed position when the projecting part is not in contact therewith.

7. A container according to claim 1, wherein the control means (40, 140, 240, 340, 440, 540) is detachably connected to the closing member, in particular by means of a snap connection.

8. A container according to claim 1, wherein the control means comprises a membrane-shaped element (58) which biases the closing member (40) in the closed position.

9. A container according to claim 1, wherein the first chamber (24, 124, 224, 324, 424, 524) is accommodated in a first housing (18, 118, 218, 318, 418, 518), while the second chamber (60, 160, 260, 360, 460, 560) is accommodated in a second housing, coupling means (50, 105, 250, 350, 450, 550) being provided for coupling the first housing to the second housing (52, 152, 252, 352, 452, 552), in particular coupling means for forming a snap connection.

10. A container according to claim 9, wherein the first housing (18, 118, 218, 318, 418, 518) is shell-shaped and provided with a filling opening, the coupling means comprising an intermediate part (22, 122, 222, 322, 422, 522) which can be secured in said filling opening and comprises at least the closing member and the passage opening, the intermediate part (22, 122, 222, 322, 422, 522) comprising further coupling means capable of cooperating with countercoupling means on the second housing.

11. A container according to claim 1, wherein the third chamber is at least substantially accommodated in a balloon-shaped or otherwise expandable element, such that gas egressing from the first chamber is received in said expandable element and kept separate from fluid included in the container and to be dispensed therefrom.

12. A pressure control device comprising a first chamber (24, 124, 224, 324, 424, 524) for containing a pressure fluid, a second chamber (60, 160, 260, 360, 460, 560) in which a control pressure prevails and a third chamber (62, 162, 262, 362, 462, 562) while between the first chamber (24, 124, 224, 324, 424, 524) and the third chamber (62, 162, 262, 362, 462, 562) there is provided a passage opening (28, 128, 228, 328, 428, 528) accommodating a closing member (40, 140, 240, 340, 440, 540) for closing, during normal use, the passage opening (28, 128, 228, 328, 428, 528) when the pressure in the third chamber (62, 162, 262, 362, 462, 562) is lower than the control pressure, a control means (66, 166, 266, 366, 466, 566) being movable by a displaceable or deformable part (58, 158, 258, 358, 458, 558) of the wall of the second chamber (60, 160, 260, 360, 460, 560) and arranged for displacing the closing member (40, 140, 240, 340, 440, 540) at least partially when the pressure in the third chamber (62, 162, 262, 362, 462, 562) is lower than the control pressure, to enable pressure fluid to flow under pressure from the first chamber (24, 124, 224, 324, 424, 524) to the third chamber (62, 162, 262, 362, 462, 562), biasing means being provided for biasing said closing member to a closed position, characterized in that at least the control member (66) and/or the second chamber (60, 160, 260, 360, 460, 560) are at least partially removable from the first chamber (24, 124, 224, 324, 424, 524) and said biasing means (42, 142, 242, 342, 442, 542) being provided for keeping the closing member (40, 140, 240, 340, 440, 540) in the closed position when at least the control member (66, 166, 266, 366, 466, 566) and/or the second chamber (60, 160, 260, 360, 460, 560) are at least partially removed, such that the first chamber (24, 124, 224, 324, 424, 524) can be filled while the second chamber (60, 160, 260, 360, 460, 560) and/or the control means can be stored and transported separately from the first chamber (24, 124, 224, 324, 424, 524) for use in a container according to claim 1.

13. A pressure control device, connectable to or provided with a first chamber for containing a pressure fluid, a second chamber in which a control pressure prevails and a passage opening, during use situated between the first chamber and the environment, while in the passage opening a closing member is included for closing the passage opening during normal use when the pressure in the environment is lower than the control pressure, a control means being movable by a displaceable or deformable part of the wall of the second chamber and arranged for displacing the closing member at least partially when the pressure in the environment is lower than the control pressure, to enable pressure fluid to flow under pressure from the first chamber to the environment, the pressure control device comprising an intermediate part which comprises at least the passage opening and the closing member, which intermediate part can be coupled to a first chamber, at least the control member and/or the second chamber being at least partially removable from said intermediate part, and biasing means being provided for keeping the closing member in the closed position when at least the control member and/or the second chamber are at least partially removed.

14. A method for preparing a container for dispensing a fluid under substantially constant pressure, wherein a shell-shaped holder is provided with a first part of a pressure control device, said first part at least comprising a closing member which is biased in a closed position and can be opened by an excess pressure applied thereto from the outer side, wherein a pressure fluid under said excess pressure is introduced into the holder along said closing member under relatively high pressure and, upon removal of the excess pressure, the closing member is moved into said closed position, after which a second part of the pressure control device is mounted on the first part, said second part comprising control means regulated by control pressure, which control means force the closing member into an open position against said bias when in the environment of the container a pressure prevails which is lower than said control pressure, the holder with coupled first and second parts being inserted into the container, said container being filled with a fluid to be dispensed and subsequently being closed.

15. Use of a container according to claim 1 or a pressure control device according to claim 12 for dispensing carbonated beverage, in particular beer, under substantially constant pressure.

16. Use of a method according to claim 14 for preparing a container with carbonated beverage, in particular beer, for dispensing said beverage.

* * * * *